US006260272B1

(12) United States Patent
Inose et al.

(10) Patent No.: US 6,260,272 B1
(45) Date of Patent: Jul. 17, 2001

(54) METHOD OF MANUFACTURING NOZZLE PLATE OF INKJET PRINTER HEAD

(75) Inventors: Toshio Inose; Jun Isono, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/089,234

(22) Filed: Jun. 2, 1998

(30) Foreign Application Priority Data

Jun. 16, 1997 (JP) ..... 9-158237

(51) Int. Cl.[7] ..... B21D 53/76; B41J 2/135; B24B 49/02

(52) U.S. Cl. ..... 29/890.1; 347/45; 347/47; 451/8

(58) Field of Search ..... 29/890.1, 23.35; 347/47, 45, 68, 71; 451/6, 8

(56) References Cited

U.S. PATENT DOCUMENTS 4,422,082 * 12/1983 Louzil ..... 347/47
5,439,728 * 8/1995 Morozumi et al. ..... 347/68
5,640,184 * 6/1997 Moynihan et al. ..... 347/47
5,762,536 * 6/1998 Pant et al. ..... 451/6
5,900,892 * 5/1999 Mantell et al. ..... 347/47

FOREIGN PATENT DOCUMENTS 5-229127 * 9/1993 (JP) ..... 29/890.1

OTHER PUBLICATIONS

Fabrication of Ink–Jet Printer Head Components by Trough– Mask Electrochemical Micromachining, IBM Technical Disclosure Bulletin, vol. 35, No. 1B, pp. 453–454, Jun. 1992.*

* cited by examiner

*Primary Examiner*—Lee Young
*Assistant Examiner*—A. Dexter Tugbang
(74) *Attorney, Agent, or Firm*—Oliff & Berridge, PLC

(57) ABSTRACT

A method of manufacturing a nozzle plate and having a nozzle passage therethrough is provided as follows. First, a member having an ink ejection surface and an nozzle passage is formed. The member includes a straight conduit portion which is formed at one end portion of the nozzle passage located near the ink ejection surface and extending straight to an opening of the nozzle passage located on the ink ejection surface in order to eject an ink straight. A recess is formed on the ink ejection surface of the member such that an area of an opening of the recess is greater than an area of the opening of the nozzle passage and such that a depth of the recess is greater than a predetermined thickness. Subsequently, the ink ejection surface is ground by the predetermined thickness on the basis of a depth of the recess remaining on the ink ejection surface after grinding.

4 Claims, 7 Drawing Sheets

METHOD OF MANUFACTURING NOZZLE PLATE OF INKJET PRINTER HEAD

BACKGROUND OF THE INVENTION

1. Field of the Invention

The present invention relates to an inkjet printer head, a nozzle plate of an inkjet printer head and a method of manufacturing a nozzle plate of an inkiest printer head.

2. Description of the Related Art

An actuator having a plurality of ink chambers in the inside and a piezoelectric element mounted on each of the ink chambers is used as an actuator of a head installed in an inkjet printer. In such an actuator, expansion and reduction of the volume of each ink chamber by the piezoelectric element applies pressure to ink in the ink chamber, and therefore, the ink is ejected to the external through an nozzle passage connected with the ink chamber.

This kind of actuator is typically constructed of a cavity plate and a nozzle plate. The cavity plate has ink chambers and ink channels to supply ink to the ink chambers. The nozzle plate has very small nozzle passages. Namely, the diameter of each nozzle passage is very small.

As the cavity plate is a member that is attached to a piezoelectric element through a diaphragm, it is necessary for the cavity plate to have a predetermined stiffness and a sufficient thickness. Furthermore, it is required that cavities each having a relatively large volume, which serves as ink chambers, ink channels, and so on, are formed in the cavity plate.

Accordingly, in fabrication of the cavity plate, it is difficult to form nozzle passages each having very small diameter on the cavity plate, together with the cavities having a relatively large stiffness and a relatively large thickness.

Therefore, the actuator has a thin nozzle plate that is a member independent of the cavity plate, and the nozzle passages are formed on the nozzle plate. Thus, it is possible to make the diameter of the nozzle passage very small. Furthermore, one end part of the ink ejection surface side of the nozzle portion, hereinafter referred to as straight conduit portion, can be shaped into straight. Accordingly, it is possible to enhance a performance to eject ink straight in the ejecting direction.

However, each of the cavity plate and the nozzle plate is a member formed by injection-molding ceramic, such as alumina, and thereafter sintering it. For this reason, in fabrication of the cavity plate and the nozzle plate by the injection molding, there is a case that burrs or flashes are formed and some nozzle passages are closed due to no good molding.

Therefore, after fabrication of the cavity plate and the nozzle plate by the injection molding, the ink ejection surface of the nozzle plate is ground in a grinding process in order to remove burrs or flashes and in order to form the nozzle passage each having a correct diameter and keep a predetermined setting length of each straight conduit portions.

However, the diameter of the nozzle passage is very small, and the length of the straight conduit portion is very short. For these reasons, there is no method of measuring the diameter of the nozzle passage and the length of the straight conduit portion, so that it is impossible to determine whether or not the diameter or the length is accurately equal to a predetermined setting value. As a result, there is a case that dispersion of the diameter or the length for each nozzle occurs.

SUMMARY OF THE INVENTION

It is therefore an object of the present invention to provide an inkjet printer head, a nozzle plate of an inkjet printer head and a method of manufacturing a nozzle plate of an inkjet printer head, which can easily form a straight conduit portion having a predetermined setting length.

According to the present invention, the above mentioned object can be achieved by an inkjet printer head having: a head body having an ink chamber; a nozzle plate attached on the head body and having a nozzle passage therethrough, a straight conduit portion being formed at one end portion of the nozzle passage located near an ink ejection surface of the nozzle plate and extending straight to an opening of the nozzle passage located on the ink ejection surface in order to eject an ink straight, another end portion of the nozzle passage being connected with the ink chamber, a recess being formed on the ink ejection surface, an area of an opening of the recess being greater than an area of the opening of the nozzle passage; and a piezoelectric element member attached on the head body for changing volume of the ink chamber.

Namely, when the nozzle plate is fabricated in manufacture of the inkjet printer head, at first, a member having at least the ink ejection surface and the nozzle passage is formed, and the inkjet ejection surface of the nozzle plate is next ground by the grinding process so as to remove burrs and flashes and to set a length of the straight conduit portion at a predetermined setting length.

In order to set a length of the straight conduit portion at the setting length correctly, it is necessary to control a grinding amount, i.e., a thickness of a part that is removed by grinding the ink ejection surface, accurately.

For this purpose, a recess is formed on the ink ejection surface. In the ink ejection surface of the nozzle plate, the area of the opening of the recess is greater than the area of the opening of the nozzle plate. Therefore, it is possible to measure a depth of the recess, and further control the thickness of the part that is removed by grinding the ink ejection surface accurately, on the basis of the measured value of the depth of the recess. For example, if the measured value of the depth of the recess after grinding is compared to the measure value of the initial depth of the recess before grinding, the thickness of the removed part can be recognized. Thus, it is possible to set the thickness of the removed part at the predetermined thickness. Consequently, it is possible to set the length of the straight conduit portion at the setting length easily and accurately.

According to the present invention, the above mentioned object can be also achieved by a nozzle plate to be used in an inkjet printer head and having a nozzle passage therethrough, a straight conduit portion being formed at one end portion of the nozzle passage located near an ink ejection surface of the nozzle plate and extending straight to an opening of the nozzle passage located on the ink ejection surface in order to eject an ink straight, a first recess being formed on the ink ejection surface, an area of an opening of the first recess being greater than an area of the opening of the nozzle passage.

Namely, when the nozzle plate is fabricated, at first, a member having at least the ink ejection surface and the nozzle passage is formed, and the inkjet ejection surface of the nozzle plate is next ground by the grinding process so as to remove burrs or flashes and to set a length of the straight conduit portion at a setting length. In order to set a length of the straight conduit portion at the setting length correctly, it is necessary to control the grinding amount, i.e., a thickness of a part that is removed by grinding the ink ejection surface, accurately.

For this purpose, a first recess is formed on the ink ejection surface. In the ink ejection surface of the nozzle plate, the area of the opening of the first recess is greater than the area of the opening of the nozzle plate. Therefore, it is possible to measure a depth of the first recess, and further control the thickness of the part that is removed by grinding the ink ejection surface accurately, on the basis of the measured value of depth of the recess. Thus, it is possible to set the thickness of the removed part at the predetermined thickness. Consequently, it is possible to set the length of the straight conduit portion at the setting length easily and accurately.

Furthermore, before the ink ejection surface is ground in the fabrication of the nozzle plate, a depth of the first recess is greater than the predetermined thickness of a part that is removed when the ink ejection surface is ground. Therefore, the first recess remains, after the ink ejection surface is ground such that the length of the straight conduit portion is equal to the setting length. Accordingly, it is possible to confirm whether or not the length of the straight conduit portion is accurately set at the setting length on the basis of measurement of depth of the recess.

Furthermore, before the ink ejection surface is ground in the fabrication of the nozzle plate, a second recess is formed on the ink ejection surface, and a depth of the second recess is equal to or less than the predetermined thickness of the part that is removed when the ink ejection surface is ground. Therefore, after the ink ejection surface is ground such that the length of the straight conduit portion is equal to the setting length, the first recess remains while the second recess disappears. Accordingly, it is possible to confirm whether or not the length of the straight conduit portion is accurately set at the setting length on the basis of disappearance of the second recess and presence of the first recess. In this case, it is not necessary to measure depth of the first recess.

Moreover, if a difference between the depth of the first recess and the depth of the second recess is set at a tolerant of a setting length of the straight conduit portion, it is possible to set the length of the straight conduit portion in the tolerant range of the setting length easily.

Moreover, if a couple of first recesses and a couple of second recesses are formed on four corners of the ink ejection surface in a shape of a quadrangle, respectively, it is possible to set the lengths of the straight conduit portions of all nozzle passages arranged in the nozzle panel at the setting length.

According to the present invention, the above mentioned object can be also achieved by a method of manufacturing a nozzle plate to be used in an inkjet printer head and having a nozzle passage therethrough, a straight conduit portion being formed at one end portion of the nozzle passage located near an ink ejection surface of the nozzle plate and extending straight to an opening of the nozzle passage located on the ink ejection surface in order to eject an ink straight, the method having the processes of: forming a member having the ink ejection surface and the nozzle passage including the straight conduit portion; forming a recess on the ink ejection surface of the member such that an area of an opening of the recess is greater than an area of the opening of the nozzle passage and such that a depth of the recess is greater than a predetermined thickness; and grinding the ink ejection surface by the predetermined thickness on the basis of a depth of the recess.

Namely, a recess is formed on the ink ejection surface. The area of the opening of the recess is greater than the area of the opening of the nozzle passage. Therefore, it is possible to measure depth of the recess. In the grinding process, it is possible to determine whether or not the ink ejection surface is ground by the predetermined thickness, on the basis of the measured value of depth of the recess. Accordingly, it is possible to set the length of the straight conduit portion at the setting length easily and accurately, on the basis of the measured value of the depth of the recess.

According to the present invention, the above mentioned object can be also achieved by a method of manufacturing a nozzle plate to be used in an inkjet printer head and having a nozzle passage therethrough, a straight conduit portion being formed at one end portion of the nozzle passage located near an ink ejection surface of the nozzle plate and extending straight to an opening of the nozzle passage located on the ink ejection surface in order to eject an ink straight, the method having the processes of: forming a member having the ink ejection surface and the nozzle passage including the straight conduit portion; forming a first recess on the ink ejection surface of the member such that an area of an opening of the first recess is greater than an area of the opening of the nozzle passage and such that a depth of the first recess is greater than a predetermined thickness, and forming a second recess on the ink ejection surface of the member such that a depth of the second recess is equal to or less than the predetermined thickness; and grinding the ink ejection surface by the predetermined thickness on the basis of disappearance of the second recess and presence of the first recess.

Namely, the depth of the first recess is greater than the predetermined thickness. The depth of the second recess is equal to or less than the predetermined thickness. As a result, after the ink ejection surface is correctly ground by the predetermined thickness, the second recess disappears while the first recess remains. Thus, it is possible to determine whether or not the ink ejection surface is ground by predetermined thickness correctly on the basis of disappearance of the second recess and presence of the first recess. Accordingly, it is possible to set the length of the straight conduit portion at the setting length easily and accurately.

Furthermore, if a difference between the depth of the first recess and the depth of the second recess is set at a tolerant of a setting length of the straight conduit portion, in the process of forming the first recess and the second recess, it is possible to set the length of the straight conduit portion in the tolerant range of the setting length easily.

Moreover, if a couple of first recesses and a couple of second recesses are formed on four corners of the ink ejection surface in a shape of a quadrangle, respectively, in the process of forming the first recess and the second recess, it is possible to set the lengths of the straight conduit portions of all nozzle passages arranged in the nozzle panel at the setting length.

The nature, utility, and further feature of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Referring with the accompanying drawings, embodiments of the present invention will be now explained.

Figure 1:
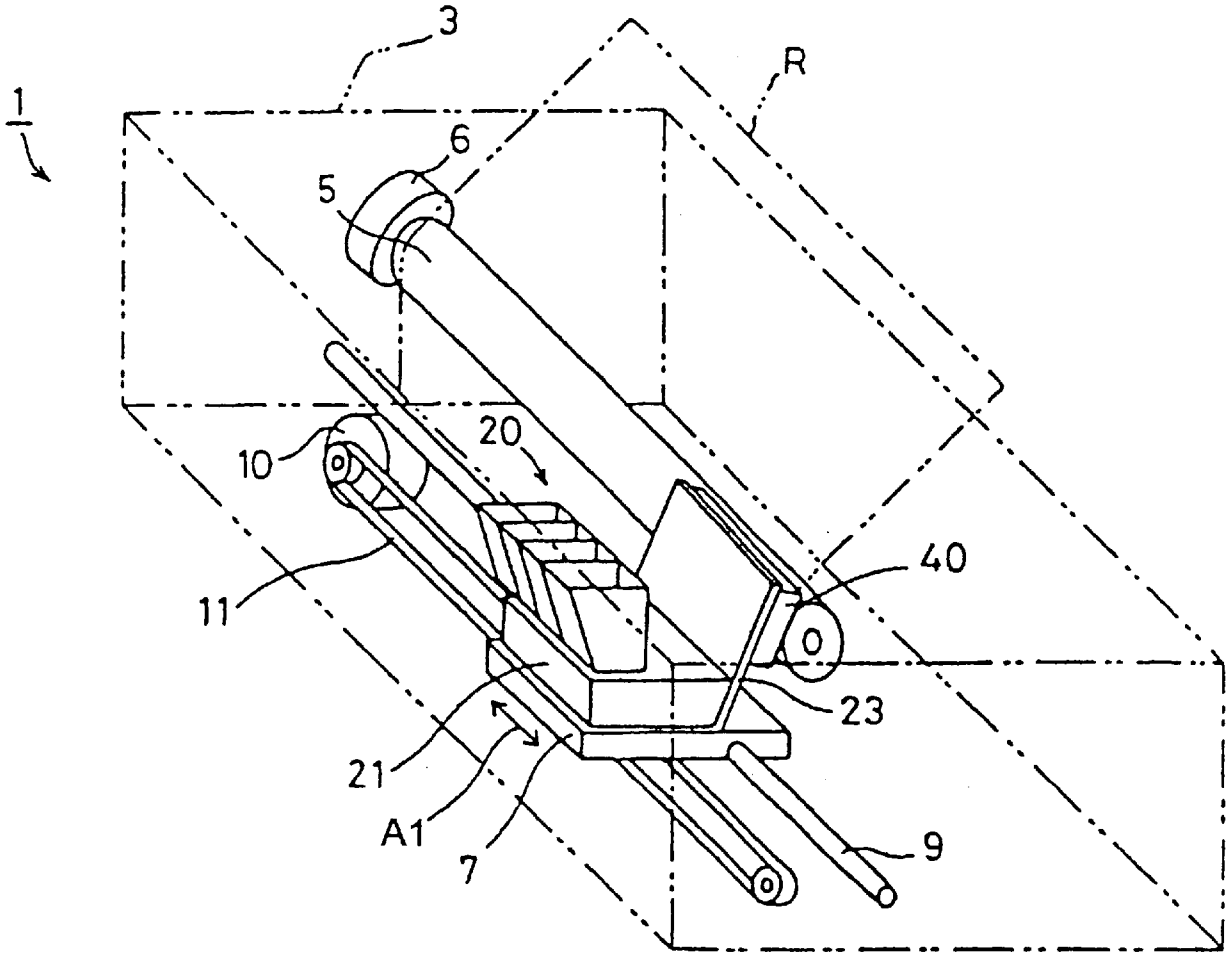
FIG. 1 is a perspective diagram showing the inside of a printer of an embodiment of the present invention.

FIG. 1 is a perspective diagram showing an internal configuration of an inkjet printer 1. An inkjet printer head of an embodiment of the present invention is installed in the printer 1, as explained below.

In FIG. 1, the printer 1 has a body 3. A conveyance roller 5 is disposed in the body 3. The conveyance roller 5 is driven by a conveyance motor 6, and conveys a recording paper R or recording medium to the upper side of the printer 1. A head 20 is disposed on the way of a conveyance path of the recording paper R, and is supported by a carriage 7. The carriage 7 is reciprocatable supported by a supporting member 9, and can reciprocate in the orthogonal direction of the recording paper conveyance direction A1. A timing belt 11 is fixed to the carriage 7. When a carriage motor 10 is driven, the timing belt 11 and the carriage 7 are moved in the direction A1.

The head 20 has: a plurality of ink tanks 21, which respectively correspond to 4 color of inks (yellow, magenta, cyan, black); a plurality of actuators 40, which respectively correspond to the inks, for ejecting the inks; and a front panel 23 for sending the inks from the ink tanks 21 to the actuators 40.

Figure 2:
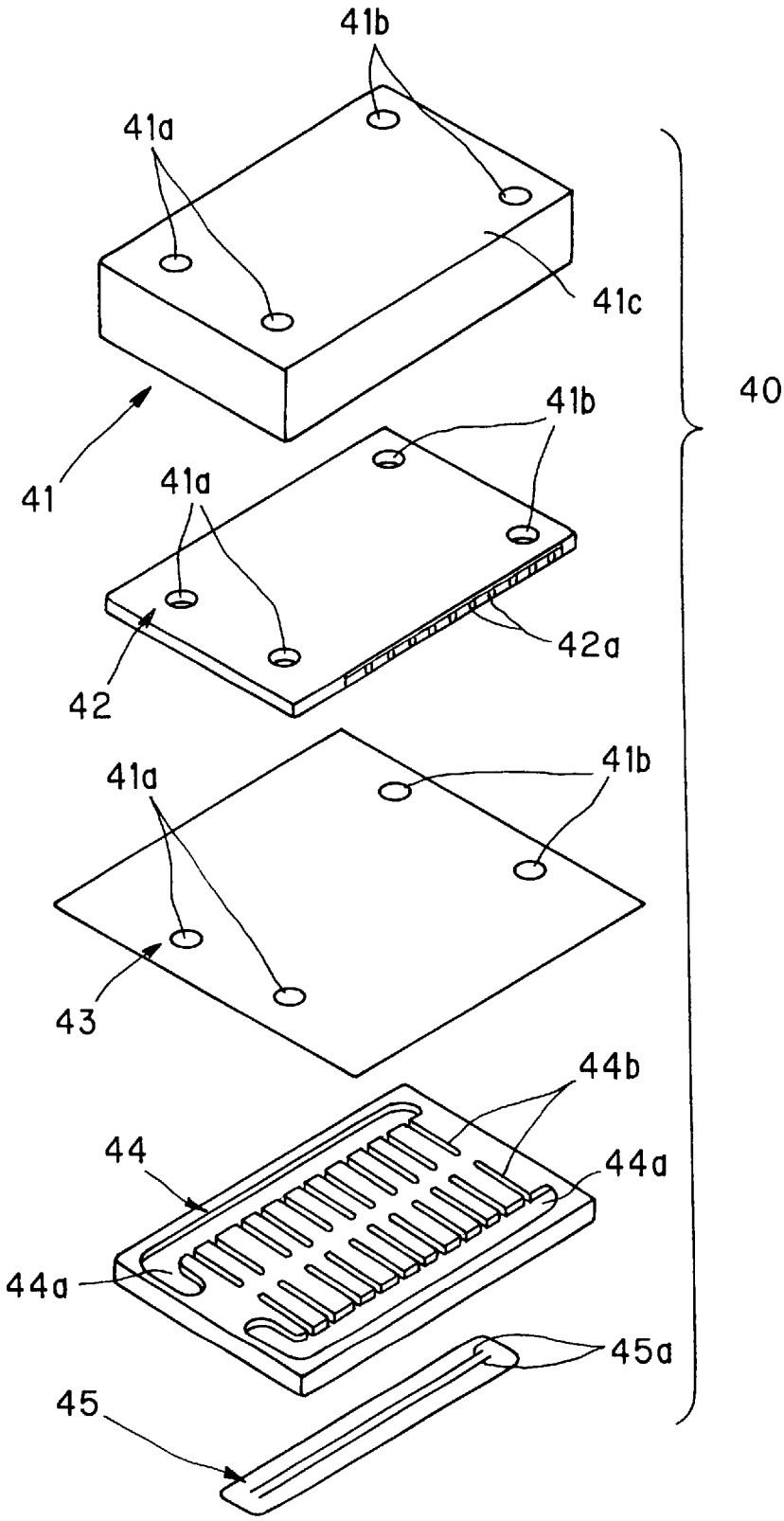
FIG. 2 is a perspective diagram showing assembly of an actuator of the printer of the embodiment.

As shown in FIG.2, the actuator 40 has: a base 41; a piezoelectric element member 42; a diaphragm 43; a cavity plate 44; and a nozzle plate 45.

The base 41 supports the aforementioned parts constructing the actuator 40.

Figure 3:
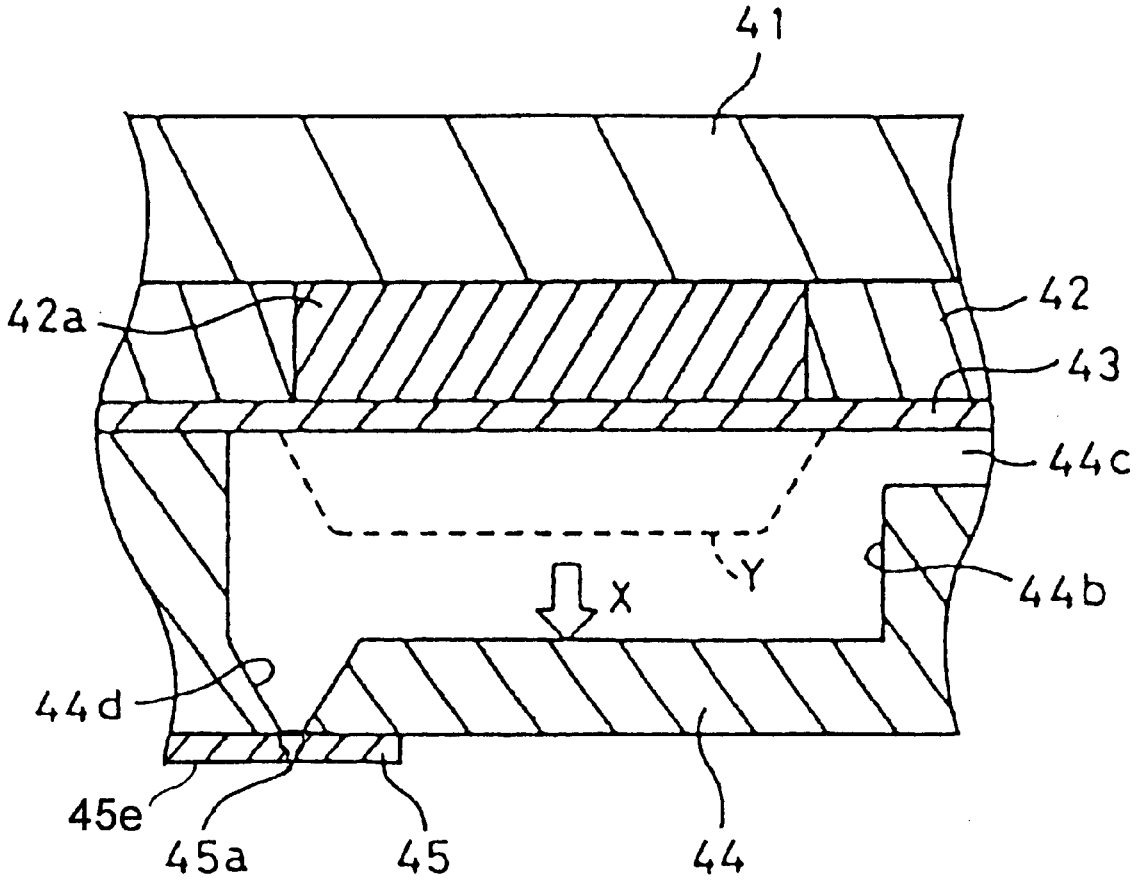
FIG. 3 is a longitudinal sectional view showing the actuator of the printer of the embodiment.

The piezoelectric element member 42 has a large number of piezoelectric elements 42*a,* for example, 128 piezoelectric elements 42*a,* in order to enable to independently expand and reduce ink chambers 44*b* of the cavity plate 44 for each of the ink chambers 44*b*. As shown in FIG.3, when a driving voltage is applied to each piezoelectric element 42*a,* the piezoelectric element 42*a* expands in the direction X. Therefore, as shown by a dotted line Y, the volume of the ink chamber 44*b* is reduced. When the driving voltage is stopped, the piezoelectric element 42*a* is shrunken, and returned to the initial shape.

The diaphragm 43 separates the piezoelectric element member 42 from cavity plate 44, and it has elasticity.

The cavity plate 44 serves as a head body. Furthermore, as shown in FIG. 2, a couple of ink channels 44*a* each shaped like "L" and the plurality of ink chambers 44b branching from each ink channel 44*a* at a right angles are formed on the cavity plate 44. The number of the ink chambers 44*b* correspond to the number of nozzle passages 45*b*. Each of the ink chambers 44*b* is connected with the corresponding nozzle passage 45*b*. Furthermore, as shown in FIGS. 2 and 3, each of the ink chambers 44*b* formed on the cavity plate 44 is connected with the ink channel 44*a* through a communicating channel 44*c*. Moreover, as shown in FIG. 3, a plurality of orifices 44*d* are formed in the lower part of the cavity plate 44. Each orifice 44*d* is connected the ink chamber 44*b* with the nozzle passage 45*b*.

The nozzle plate 45 is a flat plate. A large number of the nozzle passages 45*b* are formed through the nozzle plate and arranged in two rows. For example, the number of the nozzle passages 45*b*

In addition, as shown in FIG.2, a couple of ink supply holes 41*a* and a couple of ink return holes 41*b* are formed in the base 41, the piezoelectric element member 42 and the diaphragm 43 respectively. The ink circulates between ink tanks 21 and the ink channels 44*a* through the ink supply holes 41*a* and the ink return holes 41*b*.

Next, an ink ejection operation of the actuator 40 of the head 20 is explained.

An ink flows from the ink tank 21 to the ink channels 44*a* through the ink supply holes 41*a* by applying pressure, and the ink channels 44*a* are filled with the ink. Then, the driving voltage of the piezoelectric elements 42*a* is cut off, and therefore, each piezoelectric element 42*a* is shrunken. Thus, the ink is supplied from the ink channels 44*a* to the ink chambers 44*b* through the communication channels 44*c,* and the ink chambers 44*b* are filled with the ink.

Next, the driving voltage is applied to the piezoelectric elements 42*a,* and therefore, the volume of each ink chamber 44*b* reduces. Thus, the ink in each ink chamber 44*b* flows into the nozzle passage 45*b* of the nozzle plate 45 through the orifice 44*d,* and is ejected from the ink ejection opening 45*a* of the nozzle passage 45*b* to the external.

At this time, the ink is accurately ejected through the ink ejection opening 45*a*, which has very small diameter.

Figure 4A:
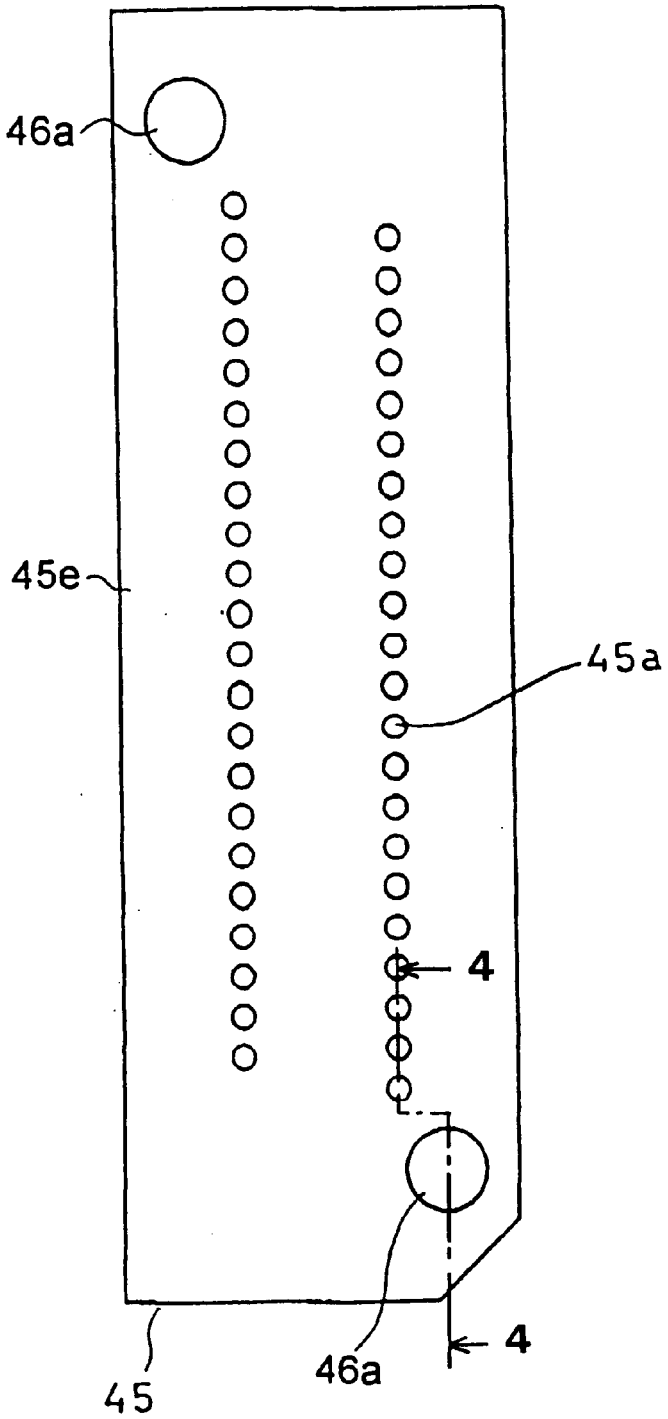
FIG. 4A is a plan view showing an outline configuration of a nozzle plate after a molding process and a grinding process according to the embodiment.
Figure 4B:
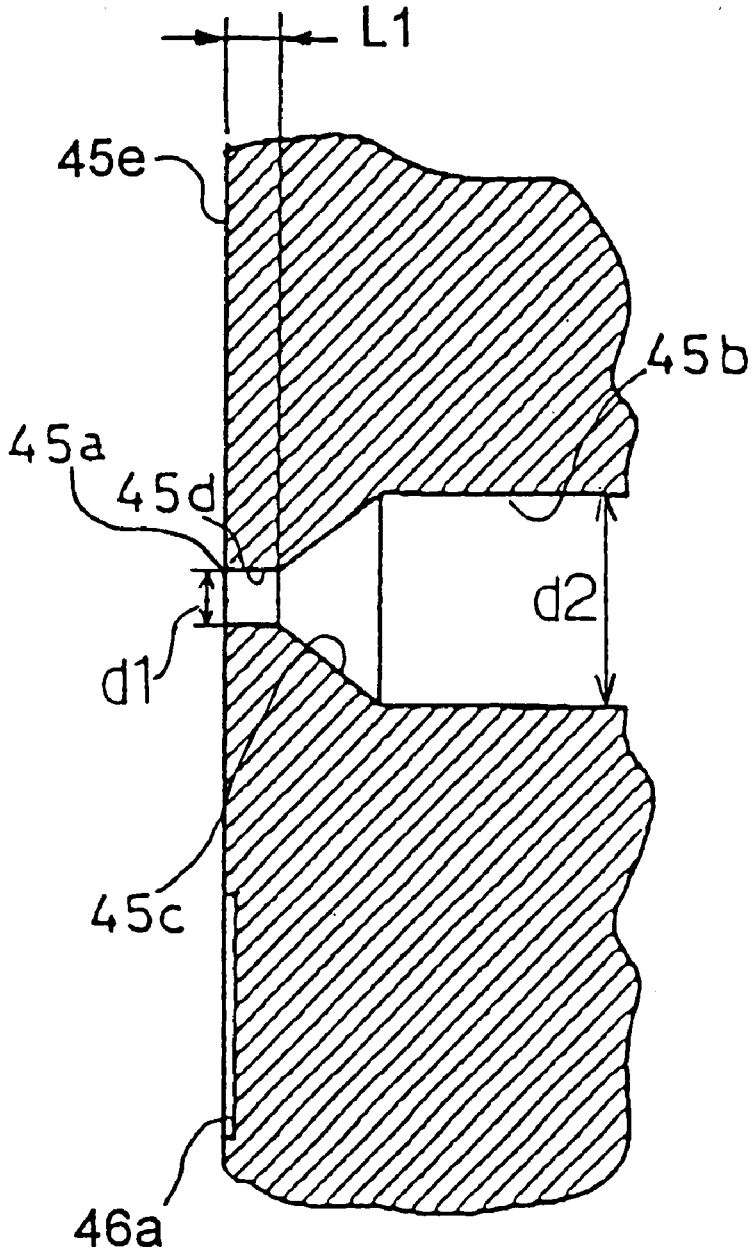
FIG. 4B is a sectional view taken on line 4—4 of FIG.4A.

Next, the configuration of the nozzle plate 45 is explained with reference to FIGS. 4A and 4B. FIG. 4A is a plan view of the nozzle plate 45. FIG. 4B is a sectional view taken on line 4—4 of FIG. 4A.

As shown in FIG. 4A, the plurality of nozzle passages 45*b* are formed through the nozzle plate 45, and an ink ejection opening 45*a* of each nozzle passage 45*b* is arranged on the ink ejection surface 45*e* of the nozzle plate 45. As shown in FIG. 4B, the ink ejection opening 45*a* is the opening portion of the nozzle passage 45*b* located on the ink ejection surface 45*e*. The diameter d1 of the ink ejection opening 45*a* is much less than the diameter d2 of the opposite side of the nozzle passage 45*b,* which is connected with the orifice 44*b* of the cavity plate 44.

More specifically, as shown in FIG. 4B, the nozzle passage 45*b* has a contraction portion 45*c* and the straight conduit portion 45*d*. The contraction portion 45*c* is the part that the diameter of the nozzle passage 45*b* gradually becomes small from the side connected with the orifice 44*d* toward the ink ejection opening 45*a*. The straight conduit portion 45*d* is the part positioned between the ink ejection opening 45*a* (ink ejection surface 45*e*) and the contraction portion 45*c*.

The straight conduit portion 45*d* functions in order to enhance a performance to eject the ink straight in the ejecting direction. The straight conduit portion 45*d* is very important for high accuracy of printing. Namely, to set and keep the length of the straight conduit portion 45*d* at a predetermined setting length L1 accurately is very important for controlling the ejection of ink accurately.

Here, the nozzle plate 45 is a member formed by injection-molding ceramic, such as alumina, and thereafter sintering it. Therefore, in fabrication of the nozzle plate 45, a grinding process is carried out in order to remove burrs or flashes and loading of the nozzle passages 45*b,* after the molding process.

In order to set the length of the straight conduit portion 45*d* at the setting length L1, the first thickness of the nozzle plate 45 is designed in consideration of the part that will be removed in the grinding process. That is, the first thickness of the nozzle plate 45 is thicker than the final thickness of the nozzle plate 45. Namely, the nozzle plate 45 has the first thickness immediately after the mold process. Thereafter, the ink ejection surface 45*e* of the nozzle plate 45 is ground in the grinding process. As a result, the thickness of the nozzle plate 45 is reduced to the final thickness, and the length of the straight conduit portion 45*d* is set at the setting length L1.

Furthermore, in the embodiment, in order to set the length of the straight conduit portion 45*d* at the setting length L1 accurately and easily, a plurality of determination marks 46*a* and 46*b* are formed on the ink ejection surface 45*e* of the nozzle plate 45. The determination marks 46*a* and 46*b* are formed before the grinding process. For example, the determination marks 46*a* and 46*b* are formed in the injection-molding process, together with the ink ejection surface 45*e,* the nozzle passage 45*b* and so on. The determination marks 46*a* and 46*b* are used for determination of the grinding amount of the nozzle plate 45 in the grinding process.

Figure 5A:
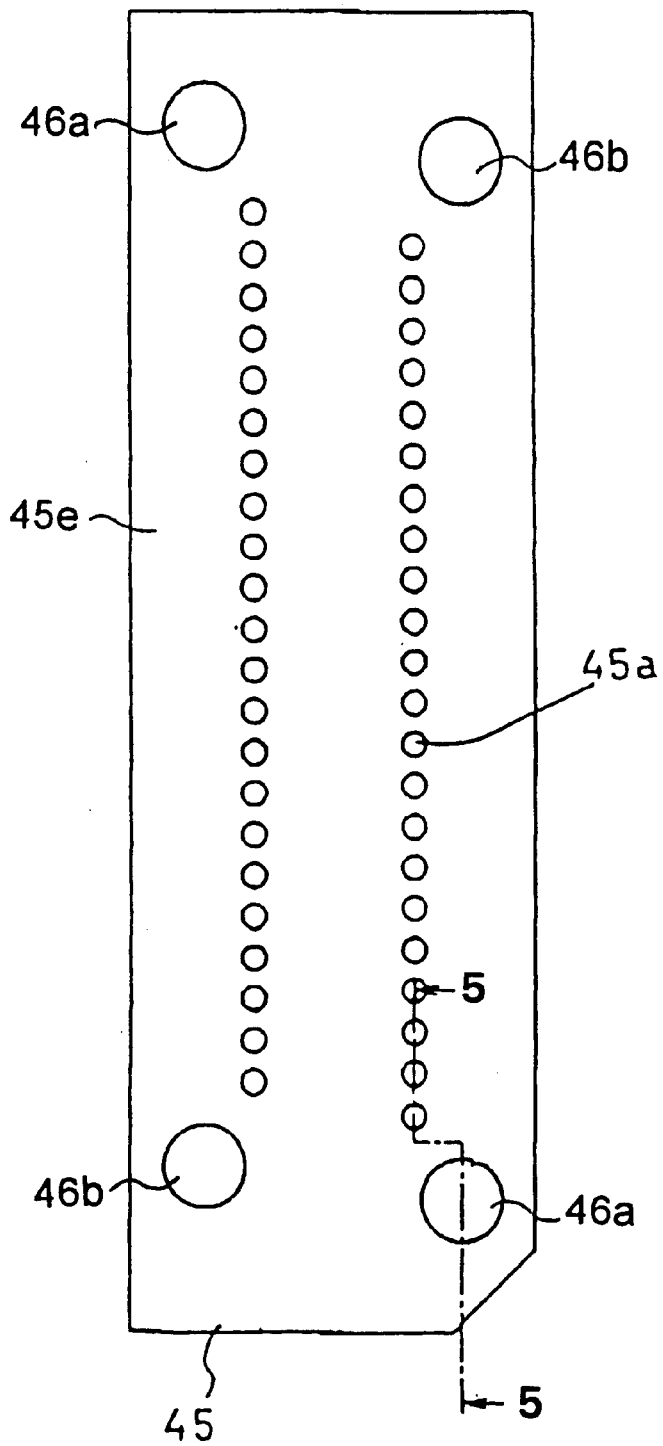
FIG. 5A is a plan view showing an outline configuration of the nozzle plate before the molding process and the grinding process according to the embodiment.
Figure 5B:
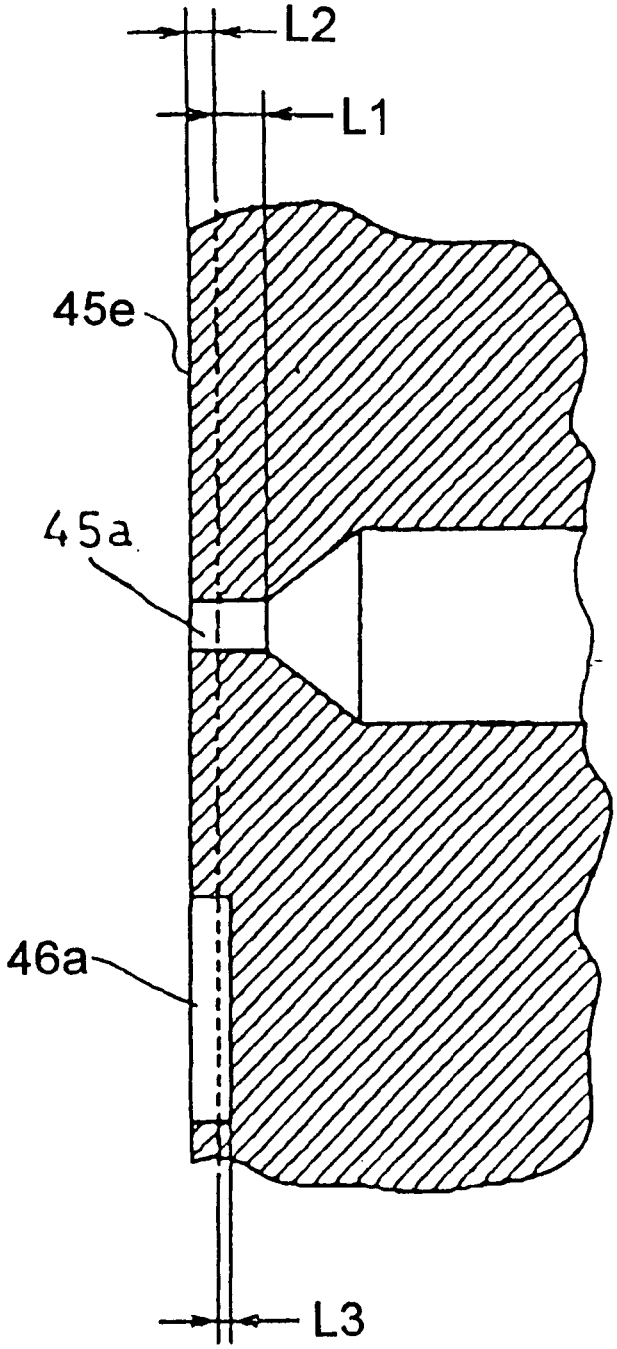
FIG. 5B is a sectional view taken on line 5—5 of FIG.5A.

In the embodiment, as shown in FIGS. 5A and 5B, each of the determination marks 46*a* and 46*b* is a recess formed on the ink ejection surface 45*e* of the nozzle plate 45. The total number of the determination marks 46*a* and 46*b* is four, and the determination marks 46*a* and 46*b* are respectively arranged in the four corners of the nozzle plate 45 in the shape of a quadrangle. As shown in FIG. 5B, before the grinding process is carried out, the depth of each determination mark 46*a* is greater than the predetermined thickness L2 of the part that will be removed in the grinding process. Therefore, each determination mark 46*a* remains after the grinding process. As shown in FIG. 5B, after the grinding process, the depth of each determination mark 46*a* is reduced to the depth L3. A worker or an operator can observe the determination marks 46*a* with his or her eyes during the grinding process and after the grinding process. Further, the diameter of each of the determination marks 46*a* and 46*b* is much greater than that of the ink ejection opening 45*a*. That is, the opening area of each of the determination marks 46*a* and 46*b* is much larger than the area of the ink ejection opening 45*a,* so that it is possible to measure the depth of each determination marks 46*a*. Therefore, if the depth of each determination mark 46*a* is measured during and after the grinding process, the grinding amount, i.e., the thickness of the part that has been removed in the grinding process, is recognized.

Furthermore, in the embodiment, the depth of each determination mark 46*b* is equal to or less than the thickness L2 of the part that will be removed in the grinding process. As shown in FIG. 4A, after the grinding process is carried out correctly, both determination marks 46*b* disappear.

Moreover, in the embodiment, the difference between the depth of each determination mark 46*a* and the depth of the each determination mark 46*b* is set within a range of a tolerance of the length of the straight conduit portion 45*d*. In the grinding process, a worker or an operator can recognize that the grinding process is carried out correctly, by confirming disappearance of the determination marks 46*b* and presence of the determination marks 46*a*. Thus, the worker or the operator can set the length of the straight conduit portion 45*d* within its tolerance range.

In addition, in the embodiment, the determination marks 46*a* and 46*b* are arranged in four corners of the nozzle plate 45, respectively. However, the number or arrangement is not limited to this. Only one determination mark 46*a* may be formed. In this case, a worker or an operator can recognize the grinding amount by measuring a depth of the determination mark 46*a*. On the other hand, if at least a couple of determination marks 46*a* and 46*b* may be formed, a worker or an operator can recognize that the grinding process is carried out correctly, by confirming disappearance of the determination mark 46*b* and presence of the determination mark 46*a*. In this case, the measurement of the depth of the determination mark 46*a* is not necessary.

As explained above, according to the present invention, it is possible to easily and accurately recognize the correct grinding amount, and it is possible to easily and accurately set the length of the straight conduit portion 45*d* of the nozzle passage 45*b* at the setting length L1. Accordingly, it is possible to produce the inkjet printer having no dispersion of the ejecting direction of ink and to realize high quality printing.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of manufacturing a nozzle plate to be used in an inkjet printer head and having a nozzle passage therethrough, a straight conduit portion being formed at one end portion of the nozzle passage located near an ink ejection surface of the nozzle plate and extending straight to an opening of the nozzle passage located on the ink ejection surface in order to eject an ink straight, the method comprising the processes of:

forming a member having the ink ejection surface and the nozzle passage including the straight conduit portion;

forming a recess on the ink ejection surface of the member such that an area of an opening of the recess is greater than an area of the opening of the nozzle passage and such that a depth of the recess is greater than a predetermined thickness;

grinding the ink ejection surface by the predetermined thickness on the basis of the depth of the recess remaining on the ink ejection surface after grinding; and forming a second recess on the ink ejection surface of the member such that an area of an opening of the second recess is greater than an area of the opening of the nozzle passage and such that a depth of the recess is less than the predetermined thickness, wherein grinding the ink ejection surface causes the second recess to disappear thereby establishing the straight conduit portion within a range of tolerance.

2. A method of manufacturing a nozzle plate to be used in an inkjet printer head and having a nozzle passage therethrough, a straight conduit portion being formed at one end portion of the nozzle passage located near an ink ejection surface of the nozzle plate and extending straight to an opening of the nozzle passage located on the ink ejection surface in order to eject an ink straight, the method comprising the process of:

forming a member having the ink ejection surface and the nozzle passage including the straight conduit portion;

forming a first recess on the ink ejection surface of the member such that an area of an opening of the first recess is greater than an area of the opening of the nozzle passage and such that a depth of the first recess is greater than a predetermined thickness, and forming a second recess on the ink ejection surface of the member such that a depth of the second recess is equal to or less than the predetermined thickness; and grinding the ink ejection surface by the predetermined thickness on the basis of disappearance of the second recess by the grinding and presence of the first recess remaining on the ink ejection surface after grinding.

3. The method according to claim 2, wherein a difference between the depth of the first recess and the depth of the second recess is set at a tolerant of a setting length of the straight conduit portion, in said process of forming the first recess and the second recess.

4. The method according to claim 2, wherein a couple of said first recesses and a couple of said second recesses are formed on four corners of the ink ejection surface in a shape of a quadrangle, respectively, in said process of forming the first recess and the second recess.

* * * * *